US010143350B2

(12) United States Patent
DeJonge

(10) Patent No.: US 10,143,350 B2
(45) Date of Patent: Dec. 4, 2018

(54) CAP AND RECEIVER FOR COUPLING A CONTAINER TO A SURFACE CLEANING DEVICE

(71) Applicant: BISSELL Homecare, Inc., Grand Rapids, MI (US)

(72) Inventor: Mitchell DeJonge, Fruitport, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 232 days.

(21) Appl. No.: 15/260,391

(22) Filed: Sep. 9, 2016

(65) Prior Publication Data

US 2017/0065138 A1 Mar. 9, 2017

Related U.S. Application Data

(60) Provisional application No. 62/216,012, filed on Sep. 9, 2015.

(51) Int. Cl.
*A47L 11/40* (2006.01)

(52) U.S. Cl.
CPC ..... *A47L 11/4083* (2013.01)

(58) Field of Classification Search
CPC ..... A47L 11/4013
See application file for complete search history.

(56) References Cited

U.S. PATENT DOCUMENTS

| | | | | |
|---|---|---|---|---|
| 5,102,010 | A | 4/1992 | Osgar et al. | |
| 5,573,046 | A | 11/1996 | Venooker et al. | |
| 5,842,682 | A | 12/1998 | Schennum et al. | |
| 5,862,948 | A | 1/1999 | Duchon et al. | |
| 5,884,679 | A | 3/1999 | Hansen et al. | |
| 6,081,962 | A | 7/2000 | Kasen et al. | |
| 6,158,486 | A | 12/2000 | Olson et al. | |
| 6,167,586 | B1 | 1/2001 | Reed, Jr. et al. | |
| 6,325,115 | B1 | 12/2001 | Cowland et al. | |
| 6,488,058 | B1 | 12/2002 | Dyer et al. | |
| 6,923,345 | B1 | 8/2005 | Laible | |
| 6,971,549 | B2 | 12/2005 | Leifheit et al. | |
| 7,156,324 | B2 | 11/2007 | Birrenkott et al. | |
| 7,819,381 | B2 | 10/2010 | Abe | |
| 7,832,593 | B2 | 11/2010 | Raterman et al. | |
| 7,837,132 | B2 | 11/2010 | Mazooji et al. | |
| 2007/0199616 | A1* | 8/2007 | Chotenovsky ..... | A61M 16/183 141/351 |
| 2011/0107545 | A1 | 5/2011 | Cagnina et al. | |

FOREIGN PATENT DOCUMENTS

EP 0268451 A2 11/1987

* cited by examiner

*Primary Examiner* — Jason K Niesz
(74) *Attorney, Agent, or Firm* — McGarry Bair PC

(57) ABSTRACT

A system for coupling a container storing a treating chemistry to a surface cleaning device capable of dispensing the treating chemistry to a surface to be cleaned includes a cap provided on the container and a receiver provided on the surface cleaning apparatus. The cap and receiver include plunger valve assemblies that are opened when the cap is coupled with the receiver.

19 Claims, 10 Drawing Sheets

CAP AND RECEIVER FOR COUPLING A CONTAINER TO A SURFACE CLEANING DEVICE

CROSS-REFERENCE TO RELATED APPLICATION(S)

This application claims the benefit of U.S. Provisional Patent Application No. 62/216,012, filed Sep. 9, 2015, which is incorporated herein by reference in its entirety.

BACKGROUND

The embodiments of the invention generally relate to dispensing a treating chemistry onto household surfaces. Soft surfaces, such as carpets, rugs, and upholstery, and hard surfaces, such as bare flooring, tile, hardwood, laminate and vinyl, can become soiled by debris or other materials during use. Some surface cleaning devices, such as a vacuum cleaner, use suction to remove debris and other soiling material from the surface, while others, such as a mop, use an absorbent or attractive material collect debris and soiling material from the surface. In some instances, it may be desirable to use a treating chemistry to facilitate removal of debris and soiling material from the surface. Some surface cleaning devices include a fluid dispensing system capable of dispensing a treating chemistry to the surface to facilitate cleaning the surface.

For example, fluid dispensing systems in extraction cleaners can include a tank that can be filled with water or other treating chemistry solution that can be dispensed to the surface during use. Typically, the tank can be integrated with the extraction cleaner such that it is not removed from the cleaner during filling or the tank can be removable such that it can be removed, filled with a treating chemistry solution, and replaced within the extraction cleaner. Alternatively, some devices, such as bare floor cleaners for example, include a fluid dispensing system which is configured to receive a disposable or one time use container which stores a supply of treating chemistry. The container couples directly to the fluid dispensing system of the cleaner to provide the treating chemistry and then is disposed of and replaced with a new container when the supply of treating chemistry is exhausted.

BRIEF SUMMARY

In one aspect, the invention relates to a system for coupling a container storing a treating chemistry to a surface cleaning device capable of dispensing the treating chemistry to a surface to be cleaned, the system comprising a receiver provided on the surface cleaning device and a cap received on the container to close an open top of the container. The cap and receiver include plunger valve assemblies that are configured to engage with each other and move to an open condition upon coupling of the cap with the receiver to permit fluid to flow through the cap and receiver.

DETAILED DESCRIPTION

The embodiments of the invention relate to a container and cap assembly 10 for use with a surface cleaning device to dispense a treating chemistry to the surface being cleaned. The surface cleaning device can be any manual or powered floor cleaner known in the art for use in cleaning hard surfaces, such as wood, tile and vinyl floors, and soft surfaces, such as carpet, rugs, and upholstery. Non-limiting examples of surface cleaning devices include a stick mounted bare floor cleaner, a floor sweeper, a vacuum cleaner, a steam mop, a steam mop with vacuum cleaner, or a wet extraction cleaner. The treating chemistry can include one or more components, non-limiting examples of which include water, detergents, surfactants, solvents, fragrances, stain resist agents, anti-soiling agents, bleaches, peroxides and peroxygen containing compounds, anti-odor agents, stain removal agents, and combinations thereof.

Figure 1A:
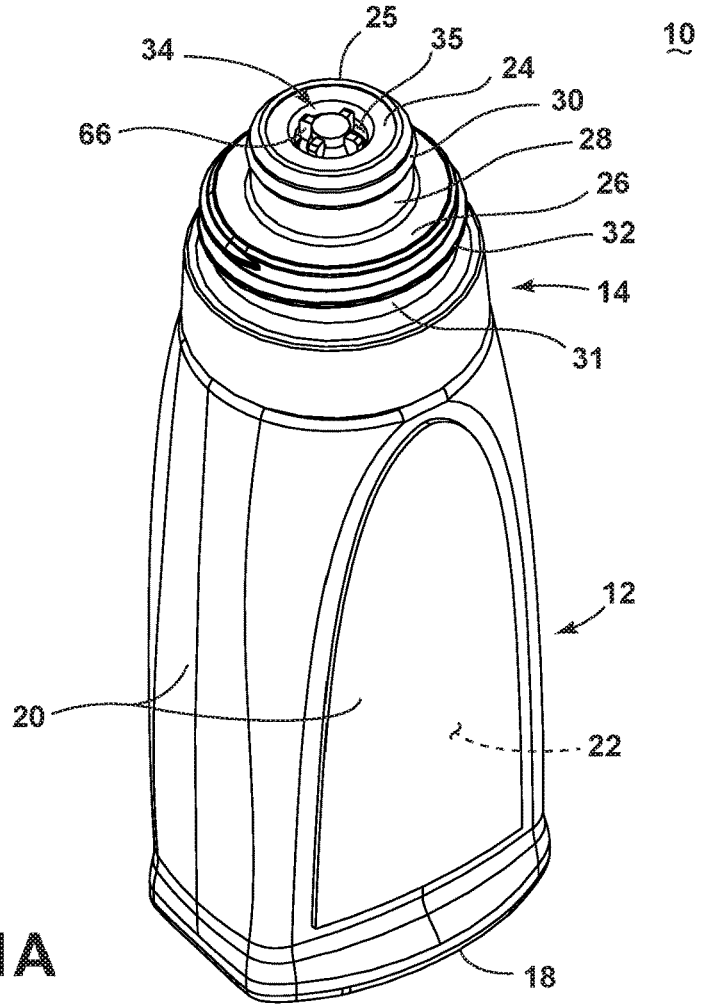
FIG. 1A is a perspective view of a container and cap assembly according to an embodiment of the invention.
Figure 1B:
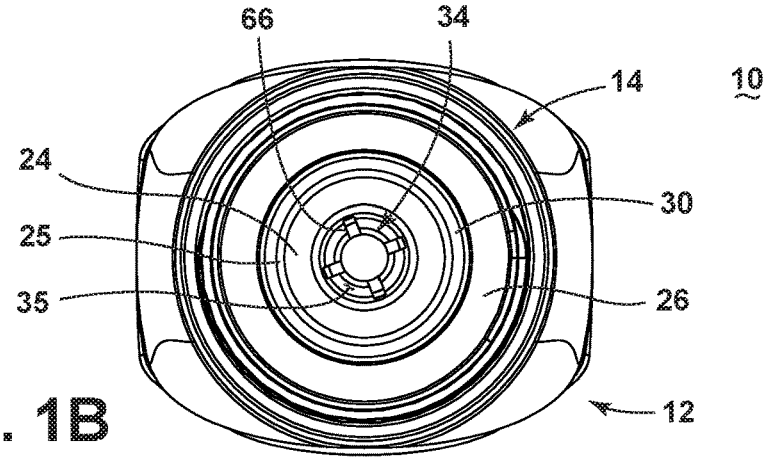
FIG. 1B is a top down view of the container and cap assembly of FIG. 1A according to an embodiment of the invention.

Referring now to FIGS. 1A and 1B, the container and cap assembly 10 includes a container 12 and a closure or cap 14. The container 12 can include a bottom wall 18 and a plurality of sidewalls 20 defining a cavity 22 for storing a treating chemistry. The container 12 can have any regular or irregular shape and can have rectangular sidewalls, square sidewalls, trapezoidal shaped sidewalls, or combinations thereof. The illustrated shape and dimensions of the container 12 are for illustration and are not germane to the embodiments of the invention. Any suitably shaped and dimension container may be used. The cap 14 can be made from any suitable polymeric material, such as polypropylene or high density polyethylene, for example. The container 12 can be made from any suitable polymeric material or glass, for example, as is known in the art.

The cap 14 can be received on the container 12 to close an open top of the container 12 and includes an end face 24, a stop wall 26, and a first annular sidewall 28 extending between the end face 24 and the stop wall 26. The end face 24 can optionally include circumferential rib 25. The annular sidewall 28 can be provided with a seal 30 in the form of an O-ring. A second annular sidewall 31 depends from the stop wall 26 and can optionally be provided with threads 32 configured for mating with corresponding threads of a suitable cover. The cap 14 can further be provided with a plunger valve assembly 34 for selectively controlling the dispensing of fluid from the container 12 through a cap outlet channel 35 provided in the cap 14.

Figure 2:
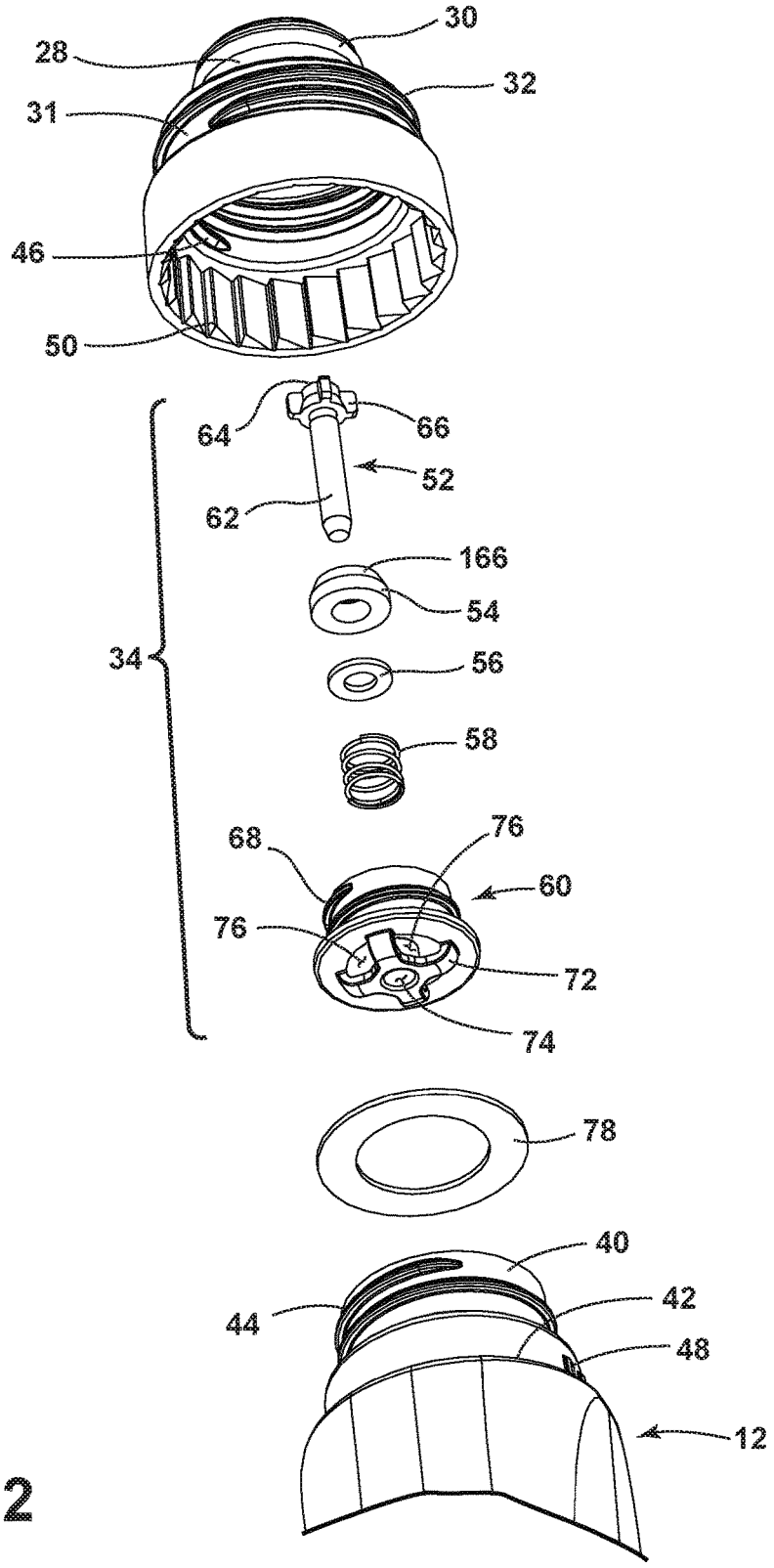
FIG. 2 is an exploded view of the container and cap assembly of FIG. 1A according to an embodiment of the invention.

Referring now to FIG. 2, the container 12 can include an open top defined by a neck 40 projecting from a top wall 42 of the container 12. The neck 40 can be configured so as to receive the cap 14 for closing the open top of the container 12. The container neck 40 can be provided with threads 44 that are configured to mate with corresponding threads 46 provided on an interior surface of the cap 14. The neck 40 can optionally include a plurality of lugs 48 which engage corresponding ribs 50 on the cap 14 to inhibit removal of the cap 14 once the cap 14 has been threaded onto the neck 40. Additionally, alternative fastening mechanisms known in the art can also be used to couple the cap 14 with the neck 40, such as a snap-fit mechanism, for example.

Still referring to FIG. 2, the cap plunger valve assembly 34 includes a cap plunger 52, a valve seal 54, a washer 56, a biasing element 58, and a retaining element 60. The cap plunger 52 includes a stem 62 and a head 64. The valve seal 54 is provided on the plunger stem 62, adjacent the plunger head 64, and is configured to control the flow of liquid from within the container 12 through the plunger valve assembly 34. The plunger head 64 can optionally be provided with a plurality of lugs or arms 66 that can provide lateral support for the valve seal 54. The biasing element 58, which is illustrated in this embodiment as a spring, biases the plunger 52 and valve seal 54 into a closed condition or closed position against the cap 14 to provide a fluid tight seal to minimize the leakage of fluid, either gas or liquid, through the cap plunger valve assembly 34. As used herein, the term fluid refers to either or both gas and liquid. The washer 56 can be provided between the valve seal 54 and the biasing element 58.

The retaining element 60 is configured to retain the plunger 52 and valve seal 54 relative to the cap 14. The retaining element 60 can include threads 68 which mate with threads 70 provided on an interior surface of the first annular sidewall 28 to secure the retaining element 60 with respect to the cap 14 (see FIG. 5A). A first end of the retaining element 60 can include a webbing 72 that includes a first aperture 74 for receiving the plunger stem 62 and a plurality of second apertures 76 which define channels through which liquid can flow through the retaining element 60. The cap 14 can further be provided with a container seal 78 that provides a fluid tight seal between the retaining element 60 and the container 12 to minimize the leakage of fluid, either gas or liquid, around the retaining element 60.

Figure 3:
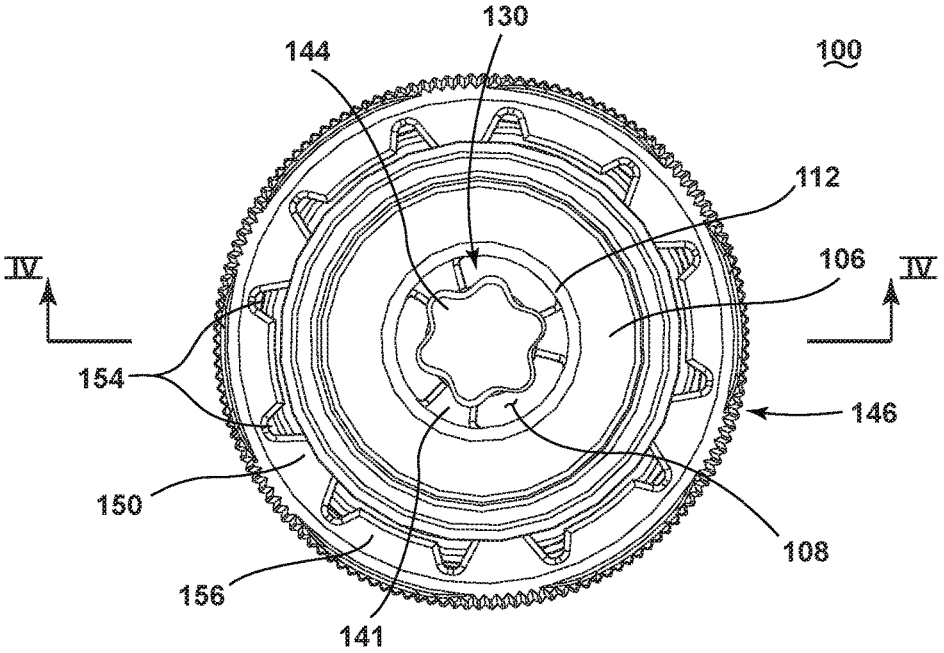
FIG. 3 is a top-down view of a receiver of a surface cleaning device according to an embodiment of the invention.
Figure 4:
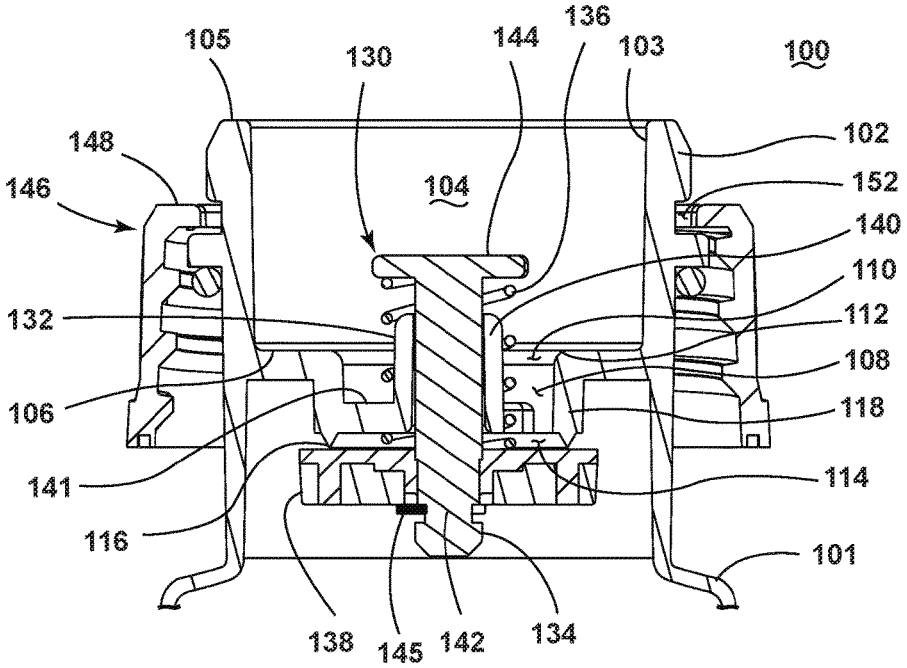
FIG. 4 is a cross-sectional view of the receiver of FIG. 3 along the line IV-IV.

FIGS. 3 and 4 illustrate an exemplary receiver 100 that can be provided on a storage tank 101 of any suitable surface cleaning device, such as a vacuum cleaner or bare floor stick cleaner, for example, that can receive the container and cap assembly 10 for receiving a treating chemistry for subsequent dispensing from the storage tank to the surface to be cleaned. The receiver 100 includes a receiver neck 102 having an inner surface 103 and defining a cavity 104 which is configured to receive the cap 14 of the container and cap assembly 10. The receiver neck 102 includes an upper end 105 defining an opening to the cavity 104 and is connected at an opposite end with a bottom wall 106. The bottom wall 106 includes a receiver inlet channel 108 through which liquid can flow through the receiver 100 into the storage tank 101. In the embodiment of FIGS. 3 and 4, the receiver inlet channel 108 has an inlet 110 defined by a rim 112 of the bottom wall 106 and an outlet 114 defined by a sealing surface 116 that is coupled with the bottom wall 106 by an annular sidewall 118 at least partially defining the receiver inlet channel 108.

The receiver 100 can further be provided with a receiver plunger valve assembly 130 positioned within the receiver inlet channel 108 to control the flow of liquid through the outlet 114 into the storage tank 101. The receiver plunger valve assembly 130 can include a retaining element 132, a receiver plunger 134, a biasing element 136, and a valve seal 138. The retaining element 132 can be a separate component or can be integrally formed with the receiver 100, as illustrated. As illustrated in FIGS. 3 and 4, the retaining element 132 includes a collar 140 that supports the receiver plunger 134 relative to the receiver inlet channel 108. The collar 140 can be supported within the receiver inlet channel 108 by a plurality of arms 141 extending between the annular sidewall 118 of the receiver inlet channel 108 and the collar 140. The valve seal 138 is received on the plunger 134 and the biasing element 136 biases the plunger 134 and the valve seal 138 into a closed condition such that the valve seal 138 seals against the sealing surface 116 of the receiver 100, preventing liquid from flowing into the storage tank 101. The valve seal 138 can provide a fluid tight seal with the sealing surface 116 to minimize the leakage of fluid, either gas or liquid, through the receiver plunger valve assembly 130.

The receiver plunger 134 includes a stem 142 and a head 144. The biasing element 136 is received by the collar 140 of the retaining element 132 and the plunger stem 142 and engages an underside of the plunger head 144. In this manner, the biasing element 136 biases the receiver plunger 134 upward towards the upper end 105 which correspondingly biases the valve seal 138 upwards against the sealing surface 116 of the receiver 100 to close the outlet 114. The valve seal 138 can be retained on the plunger stem 142 by a friction fit. A retaining ring 145 can also be provided on the stem 142 to facilitate retaining the valve seal 138 on the plunger stem 142. The plunger head 144 can have any suitable regular or irregular shape. In the embodiment of FIGS. 3 and 4, the circumference of the plunger head 144 can have a wavy profile to facilitate the flow of liquid around the plunger head 144 and into the receiver inlet channel 108. Other profiles for the plunger head 144 that facilitate the flow of liquid around the plunger head 144 are possible and include a sawtooth or chevron shape, or other irregular shapes.

The receiver 100 can further include a collar 146 which is rotatable relative to the receiver neck 102. The collar 146 includes an upper wall 148 having engaging portions 150 that engage a channel 152 provided in an outer surface of the receiver neck 102. The upper wall 148 further includes a plurality of openings or cut-outs 154 between the engaging portions 150 to provide non-engaging portions 156 of the upper wall 148 that do not engage the receiver neck 102 within the channel 152. The engaging portions 150 of the of upper wall 148 engage the channel 152 to provide support for the collar 146 while the cut-outs 154 facilitate rotation of the collar 146 relative to the receiver neck 102.

Figure 5A:
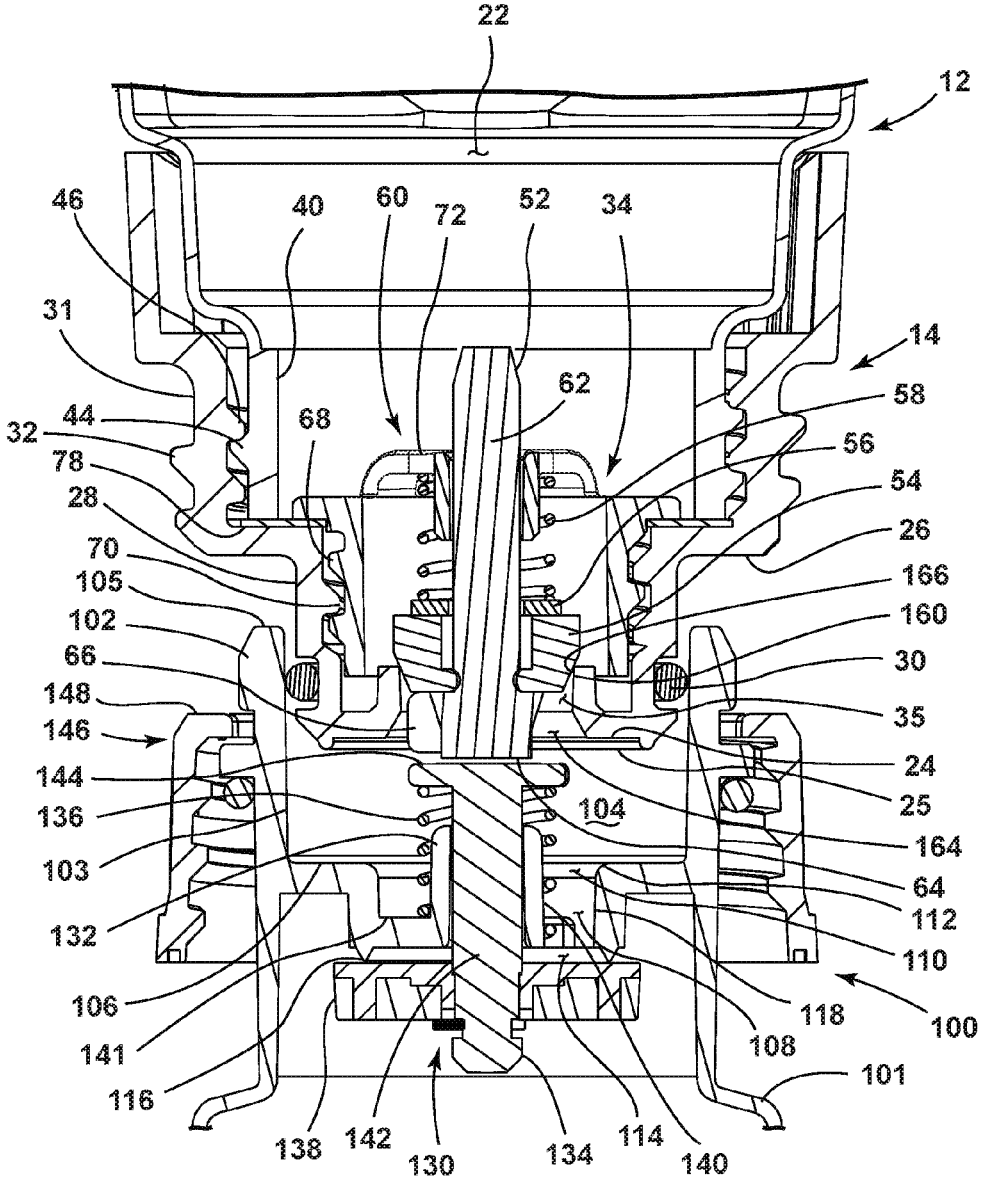
FIG. 5A is a cross-sectional view of a container and cap assembly prior to coupling with a receiver of a surface cleaning device according to an embodiment of the invention.
Figure 5B:
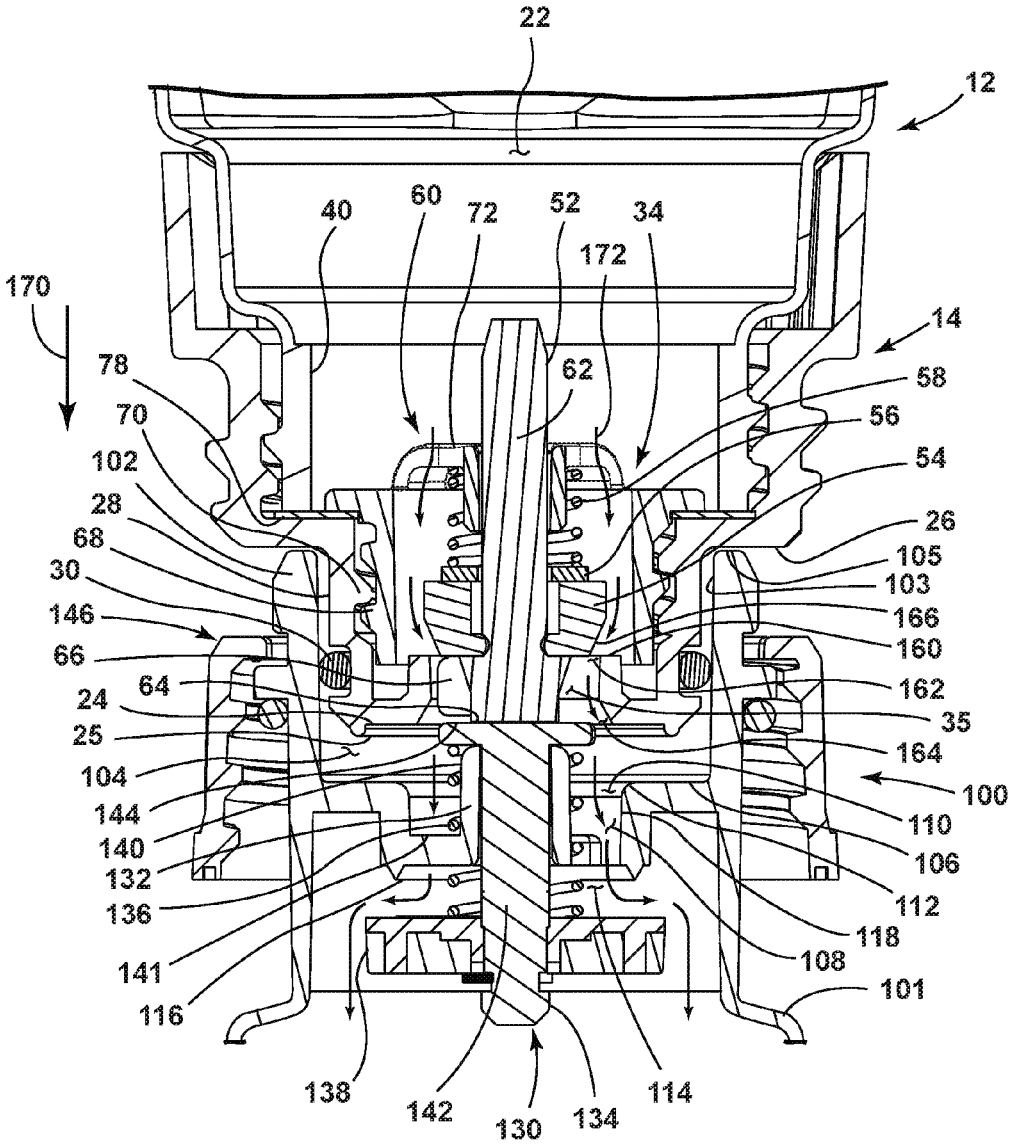
FIG. 5B is a cross-sectional view of a container and cap assembly after coupling with a receiver of a surface cleaning device according to an embodiment of the invention.

FIGS. 5A-5B illustrate the container and cap assembly 10 prior to and after coupling with the receiver 100. As can best be seen in FIG. 5A, prior to coupling the container and cap assembly 10 with the receiver 100, the cap plunger valve assembly 34 is in the closed condition in which the spring 58 biases the valve seal 54 against a rim 160 of the cap 14 defining an inlet 162 to the cap outlet channel 35 of the cap 14 through which liquid can be dispensed from within the container 12 through an outlet 164 of the cap outlet channel 35 to the receiver 100. The valve seal 54 can be provided with an angled sealing face 166 to facilitate sealing the inlet to the cap outlet channel 35 to form the fluid tight seal between the valve seal 54 and the cap rim 160 when the plunger valve assembly 34 is in the closed condition.

The receiver plunger valve assembly 130 is also in a closed condition prior to coupling of the container and cap assembly 10 with the receiver 100. As described above with respect to FIG. 4, the biasing element 136 biases the receiver plunger 134 and the receiver valve seal 138 into the closed condition in which the receiver valve seal 138 is sealed with the sealing surface 116 to prevent liquid from flowing through the outlet 114 of the receiver inlet channel 108.

Referring now to FIG. 5B, the container and cap assembly 10 can be coupled with the receiver 100 to dispense the contents of the container 12 by inserting the cap 14 into the receiver cavity 104, as illustrated by arrow 170, until the stop wall 26 engages the upper end 105 of the receiver neck 102. The dimensions of the receiver cavity 104 can be configured such that the cap seal 30 provided on the annular sidewall 28 of the cap 14 engages the inner surface 103 of the receiver cavity 104 to form a seal between the cap 14 and the receiver 100 during dispensing of the contents of the container 12. The cap seal 30 preferably forms a fluid tight or at least a liquid tight seal with the receiver neck 102 to minimize leakage and splashing of fluid during the dispensing process.

The container and cap assembly 10 and the receiver 100 can be configured such that when the container 12 is fully inserted into the receiver cavity 104 into a dispensing position in which the contents of the container 12 are dispensed into the receiver 100, the container 12 is maintained in this dispensing position based on a combination of gravity and the engagement between the cap seal 30 and stop wall 26 and the receiver 100. Additionally, or alternatively, a support structure (not shown) may be provided on the surface cleaning device associated with the receiver to support the container 12 in the dispensing position. In another embodiment, a user may be required to hold the container 12 in the dispensing position. In still another embodiment, the receiver 100 can include a locking mechanism for coupling with the cap 14, such as those disclosed in U.S. Pub. No. 2014/0263314, filed Mar. 14, 2014, entitled "Container and Cap Assembly," which is herein incorporated by reference in its entirety. While the embodiments of the invention are described in the context of the container and cap assembly 10 being withdrawn from the receiver 100 when the dispensing of the contents of the container 12 is complete, it is also within the scope of the invention for the container and cap assembly 10 to remain coupled with the receiver 100 after the contents have been dispensed.

As the container and cap assembly 10 is moved in the direction indicated by arrow 170, prior to the stop wall 26 engaging the upper end 105 of the receiver 100, the receiver plunger 134 engages the cap plunger 52. The spring constant $k_{cap}$ of the biasing element 58 of the cap plunger valve assembly 34 and spring constant $k_{receiver}$ of the biasing element 136 of the receiver plunger valve assembly 130 can be selected such that the cap plunger 52 and the receiver plunger 134 move together or separately upon engagement as the container and cap assembly 10 is moved into the dispensing position.

In a preferred embodiment, the spring constant $k_{cap}$ of the cap biasing element 58 can be greater than the spring constant $k_{receiver}$ of the biasing element 136 such that upon engagement of the cap plunger 52 and the receiver plunger 134, the receiver plunger 134 is depressed by the cap plunger 52 to open the receiver plunger valve assembly 130 prior to opening the cap plunger valve assembly 34. In this manner, the receiver plunger 134 can be depressed to move the receiver valve seal 138 away from the sealing surface 116 into an open position (FIG. 5B) such that liquid can flow through the outlet 114 of the receiver inlet channel 108 into the storage tank 101 prior to liquid being dispensed into the receiver 100.

Once the receiver plunger 134 is in the fully depressed position in which an underside of the plunger head 144 engages the collar 140 of the retaining element 132, continued movement of the container 12 in the direction of arrow 170 opens the cap plunger valve assembly 34. The collar 140 therefore forms a stop for the receiver plunger 134. Other configurations for the stop for the receiver plunger 134 can also be provided. The height of the receiver neck 102 and cap sidewall 28 can be configured such that after the receiver plunger 134 is in the fully depressed position, the cap 14 can continue to be inserted into the receiver cavity 104 to open the cap plunger valve assembly 34 before the stop wall 26 of the cap 14 engages the upper end 105 of the receiver neck 102. As the plunger 52 is depressed against the bias of the biasing element 58, the cap valve seal 54 is unseated from the cap rim 160 to open the inlet 162 to the cap outlet channel 35. As illustrated by arrows 172, when the cap plunger valve assembly 34 is open, liquid from within the container 12 can flow through the inlet 162 into the cap outlet channel 35 and out through the outlet 164, around the plunger arms 66, and into the receiver cavity 104. Because the receiver plunger valve assembly 130 is already open, liquid in the receiver cavity 104 can immediately enter the receiver inlet channel 108 through the inlet 110 and flow into the storage tank 101 through the outlet 114. Opening the receiver plunger valve assembly 130 prior to opening the cap plunger valve assembly 34 can minimize overflow or spilling of liquid from the receiver cavity 104 during the dispensing process.

When the dispensing process is complete, which may or may not correspond with emptying of the contents of the container 12, the container and cap assembly 10 can be withdrawn from the receiver 100. As the container 12 is withdrawn, the cap plunger 52 and receiver plunger 134 move back into the closed position illustrated in FIG. 5A due to the bias of their respective biasing elements 58 and 136 to close the cap plunger valve assembly 34 and receiver plunger valve assembly 130.

The relative heights of the receiver neck 102 and cap sidewall 28, the spring constants $k_{cap}$ and $k_{receiver}$ of the cap and receiver biasing elements 58 and 136, respectively, and the distance each of the plungers 52 and 134 have to travel to open the respective plunger valve assemblies 34 and 130, can be configured to control the order in which the cap plunger valve assembly 34 and receiver plunger valve assembly 130 open and close. As described above with respect to the cap and receiver plunger valve assembly 34, 130 opening process of FIG. 5B, the container and cap assembly 10 and receiver 100 can be configured such that the plunger valve assemblies 34 and 130 open and/or close at different times.

In the embodiment described above, the receiver plunger valve assembly 130 is completely opened prior to initiating opening of the cap plunger valve assembly 34. Alternatively, the container and cap assembly 10 and receiver 100 can be configured such that the receiver plunger valve assembly 130 is only partially opened prior to initiating opening of the cap plunger valve assembly 34. Additionally, or alternatively, the container and cap assembly 10 and receiver 100 to be configured such that during withdrawal of the container 12 after the dispensing process is complete, the cap plunger valve assembly 34 closes prior to the closing of the receiver plunger valve assembly 130. This can decrease the amount of liquid that may be left behind in the receiver cavity 104 after the dispensing process by allowing liquid to continue to flow through the receiver inlet channel 108 to the storage tank 101 after the supply of liquid from the container 12 is stopped.

There are several variables to take into consideration when determining the desired characteristics of the biasing elements 58 and 136 of the cap plunger valve assembly 34 and receiver plunger valve assembly 130, respectively. It is generally desirable that each valve assembly 34, 130 adequately seal their respective container 12 and tank 101 to minimize spillage in the event that the container 12, tank 101 is tilted or tipped over. Another design characteristic that can be taken into consideration is configuring the cap plunger valve assembly 34 to dispense liquid when the valve assembly 34 is fully opened or close to fully opened to avoid leakage. In addition, in a preferred embodiment, the liquid flow through the cap plunger valve assembly 34 is configured so as to not exceed the liquid flow through the receiver plunger valve assembly 130 to minimize overflow leakage.

Example

The following example demonstrates a process for determining suitable springs for use as the biasing elements 58 and 136 of the cap plunger valve assembly 34 and receiver plunger valve assembly 130 of an exemplary cap assembly 10 and receiver 100. It will be understood that the embodiments of the invention are not limited to this process, but rather that the process can be altered or replaced altogether with a different process depending on the desired design characteristics of the cap plunger valve assembly 34 and receiver plunger valve assembly 130.

Determining the desired spring characteristics can include considering the system in three different operation conditions. The first operation condition is the uncoupled condition, illustrated in FIG. 5A, prior to engagement of the cap plunger 52 and the receiver plunger 134. The amount of compression spring force required to maintain each plunger 52, 134 in the closed condition in which the respective valve seals 54, 138 are biased closed to provide the fluid tight seal is assumed for the purposes of the example to be at least 1 lbf. The amount of force $F_{cap_closed}$ required to maintain the cap plunger 52, and thus valve seal 54, in the closed, sealed condition and the amount of force $F_{rec_closed}$ required to maintain the receiver plunger 134, and thus valve seal 138, in the closed, sealed condition can be represented by the following equations:

$$F_{cap_closed}=k_{cap}*(L_{cap}-X_{cap_closed}) \quad \text{(Equation 1)}$$

$$F_{rec_closed}=k_{rec}*(L_{rec}-X_{rec_closed}) \quad \text{(Equation 2)}$$

Where, $k_{cap}$ is the spring constant of the cap spring 58; $L_{cap}$ is the uncompressed length of the cap spring 58; $X_{cap_closed}$ is the compressed length of the cap spring 58 when the cap plunger 52 is in the closed, sealed condition; $X_{cap_open}$ is the compressed length of the cap spring 58 when the cap plunger 52 is in the open, unsealed condition; $k_{rec}$ is the spring constant of the receiver spring 136; $L_{rec}$ is the uncompressed length of the receiver spring 136; $X_{rec_closed}$ is the compressed length of the receiver spring 136 when the receiver plunger 134 is in the closed, sealed condition; $X_{rec_open}$ is the compressed length of the receiver spring 136 when the receiver plunger 134 is in the open, unsealed condition.

In the present example, the cap spring 58 and receiver spring 136 have a diameter within the range of 0.30 to 0.375 inches, $X_{cap_closed}$ is 0.34 inches, $X_{cap_open}$ is 0.25 inches, $X_{rec_closed}$ is 0.39 inches, and $X_{rec_open}$ is 0.24 inches.

The second operation condition corresponds to the initial insertion of the cap assembly 10 into the receiver 100 such that the cap plunger 52 engages the receiver plunger 134 and begins to push the receiver plunger 134 against the receiver spring 136 while the cap plunger 52 remains in the closed, sealed condition. Maximizing the extent to which the receiver valve assembly 130 is open prior to opening of the cap valve assembly 34 minimizes leakage during the coupling and dispensing process. The second operation condition can be represented as:

$$F_{cap_closed}=k_{cap}*(L_{cap}-X_{cap_closed})>F_{rec_open}=k_{rec}*(L_{rec}-X_{rec_open}) \quad \text{(Equation 3)}$$

Equation 3 also represents the closing of the cap valve assembly 34 prior to the closing of the receiver valve assembly 130.

The third operation condition corresponds to the final condition in which both the cap valve assembly 34 and the receiver valve assembly 130 are fully opened such that fluid can flow from the container 12 to the storage tank 101.

Based on the dimensions of the cap valve assembly 34 and the receiver valve assembly 130 and Equations 1-3 above, the cap spring 58 can be selected to have a minimum length when compressed of less than 0.25 inches, an $F_{cap_closed}$ close to 2 lbf, and an $F_{cap_open}$ value within about 0.3-0.6 lbf of the $F_{cap_closed}$ value. Selecting a cap spring 58 with similar $F_{cap_open}$ and $F_{cap_closed}$ values insures that the forces required to open and close the cap valve assembly 34 are consistent, and therefore provide a more intuitive and desirable feel during use. The receiver spring 136 can be selected to have a minimum length when compressed of less than 0.24 inches, an $F_{rec_closed}$ between 1-2, and an $F_{rec_open}$ within about 0.3-0.6 lbf of the $F_{rec_closed}$ value. Selecting a receiver spring 136 with similar $F_{rec_closed}$ and $F_{rec_open}$ values insures that forces required to open and close the receiver valve assembly 130 are consistent, and therefore provide a more intuitive and desirable feel during operation. Tables 1 and 2 illustrate several exemplary springs having characteristics that satisfy these requirements for the cap and plunger valve assemblies 34, 130.

TABLE 1

Exemplary Springs for the Cap Valve Assemblies

| Example | Free length (in) | Outer diam. (in) | Wire diam. (in) | Compressed length (in) | Max. Force (lbf) | Spring constant (lbf/in) | Min. compressed length <0.25 inches | $F_{cap_closed}$ (target close to 2) (lbf) | $F_{cap_open}$ (lbf) |
|---|---|---|---|---|---|---|---|---|---|
| 1 | 0.75 | 0.36 | 0.026 | 0.138 | 2.52 | 6 | Yes | 2.5 | 3.0 |
| 2 | 1.125 | 0.36 | 0.026 | 0.19 | 2.56 | 3.5 | Yes | 2.8 | 3.1 |
| 3 | 1.125 | 0.36 | 0.026 | 0.19 | 2.22 | 3.04 | Yes | 2.4 | 2.7 |

TABLE 2

Exemplary Springs for the Plunger Valve Assemblies

| Example | Free length (in) | Outer diam. (in) | Wire diam. (in) | Compressed length (in) | Max. Force (lbf) | Spring constant (lbf/in) | Min. compressed length <0.24 inches | $F_{rec_closed}$ (target 1 to 2) (lbf) | $F_{rec_open}$ (lbf) |
|---|---|---|---|---|---|---|---|---|---|
| 4 | 0.75 | 0.3 | 0.022 | 0.15 | 2.09 | 3.5 | Yes | 1.2 | 1.8 |
| 5 | 0.688 | 0.3 | 0.022 | 0.128 | 1.64 | 3.91 | Yes | 1.2 | 1.8 |
| 6 | 0.875 | 0.3 | 0.022 | 0.166 | 1.64 | 2.61 | Yes | 1.37 | 1.7 |

The components of the cap assembly 10 and the receiver 100 can be selected so as to be compatible with the treating chemistry to be dispensed. Some treating chemistries can include one or more components that can interact with components of the cap assembly 10 and the receiver 100 during storage and use which can damage the components over time. In an exemplary embodiment, the cap assembly 10 and the receiver 100 can be used with a treating chemistry that includes an oxidizing agent, such as hydrogen peroxide. The plastic and metal components of the cap assembly 10 and the receiver 100 can be selected to be compatible with hydrogen peroxide. For example, materials such as polypropylene, polyphenylene-polystyrene blends, ethylene propylene diene monomer (EPDM), and stainless steel have all been found to be compatible with treating chemistries containing hydrogen peroxide.

In an exemplary embodiment, the receiver cavity 104 and collar 146, as well as both the receiver plunger 134 and cap plunger 52, can all be made from polypropylene. The valve seal 138 can be made from a polyphenylene-polystyrene blend, such as Noryl™ commercially available from SABIC Innovative Plastics, and a thermoplastic elastomer overmold that engages the sealing surface 116 to form the fluid tight seal. Seals, such as the O-ring 30, valve seal 54, and retaining element 60 can be made from EPDM. The cap biasing element 58, the receiver biasing element 136, and the retaining ring 145 can be made from stainless steel.

Figure 6:
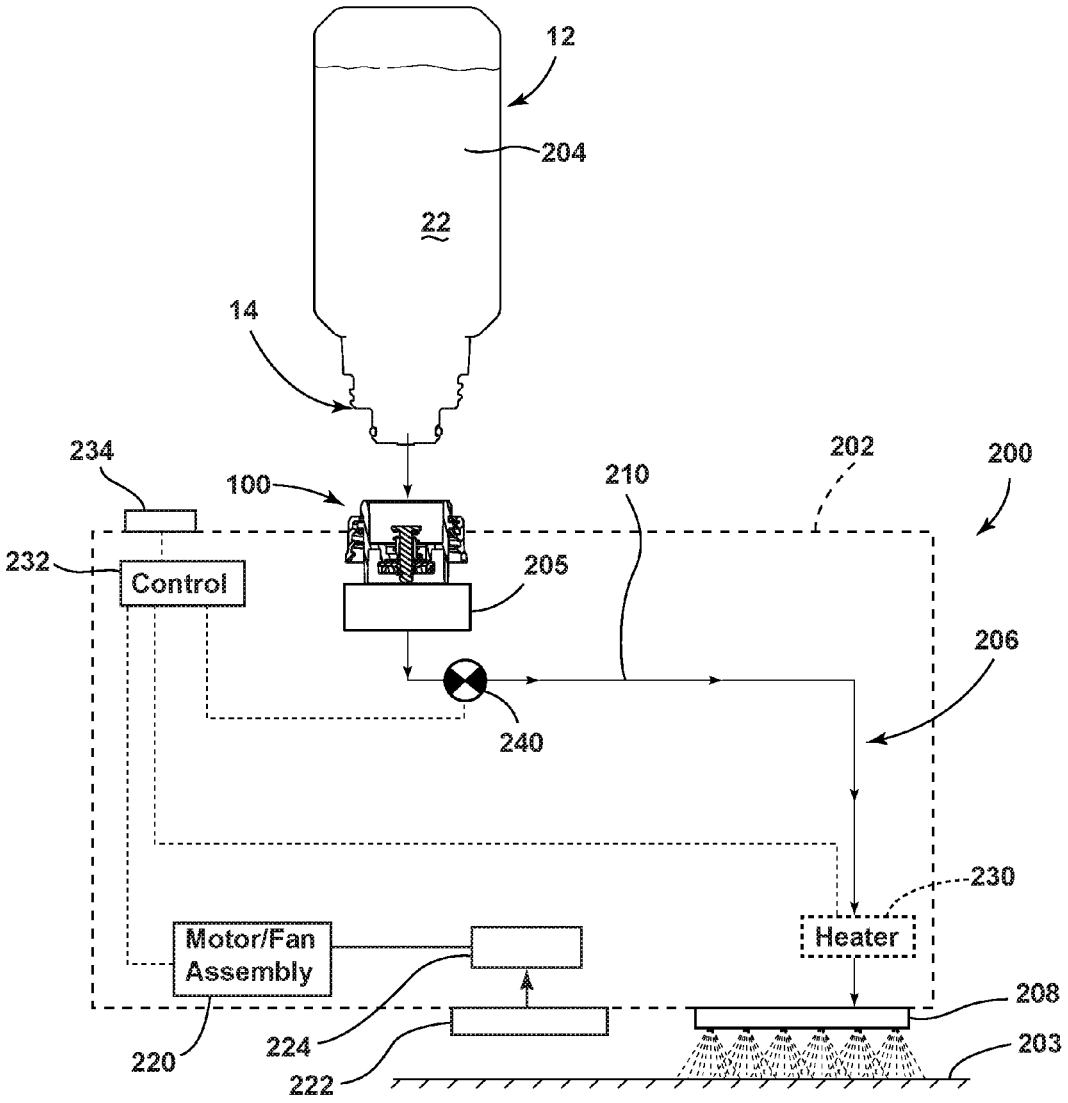
FIG. 6 is a schematic representation of a surface cleaning device including a recovery system and having a receiver for use with a container and cap assembly according to an embodiment of the invention.

FIG. 6 is a schematic representation of an exemplary fluid delivery system 200 which may be incorporated into any suitable surface cleaning device 202, such as a vacuum cleaner or an extraction cleaner, for example, that can be used with the container and cap assembly 10 for delivering a treating chemistry solution to a surface 203 to be cleaned. Prior to use of the surface cleaning device 202, the container and cap assembly 10 is coupled with the receiver 100 to dispense a treating chemistry 204 stored within the container 12 into a storage tank 205 provided with the surface cleaning device 202. The fluid delivery system 200 includes a liquid flow circuit 206 that fluidly couples the storage tank 205 with a dispenser 208, which can be part of a foot assembly (not shown), and which is configured to dispense a treating chemistry solution onto the surface 203. The liquid flow circuit 206 includes a liquid conduit 210 that fluidly couples the storage tank 205 with the dispenser 208. The liquid flow circuit 206 can include additional valves which are not shown and are not germane to the embodiments of the invention.

The surface cleaning device 202 can also include a recovery system comprising a motor/fan assembly 220 that is fluidly coupled with a nozzle assembly 222 for providing suction to draw debris and optionally spent treating chemistry solution on the surface 203 through the nozzle assembly 222 and into a recovery chamber 224. The nozzle assembly 222 can be part of a foot assembly (not shown) configured to be positioned adjacent the surface to be cleaned during use of the surface cleaning device 202. The foot assembly can further include additional components such as an agitator assembly comprising one or more agitators, such as a brush roll, for example, for agitating and providing mechanical cleaning action to the surface to be cleaned, as is known in the art of vacuum cleaners and extractors.

The recovery system can be configured to recover either or both dry and wet material from the surface 203. For example, the recovery system can be part of an extraction cleaner which is configured to recover both dry and wet material from the surface being cleaned. Non-limiting examples of suitable extraction cleaners include those described in commonly assigned U.S. Pat. No. 6,131,237 to Kasper et al., U.S. Pat. No. 7,784,148 to Lenkiewicz et al., and U.S. Pat. No. 7,320,149 to Huffman et al., which are incorporated herein by reference in their entirety. Alternatively, the recovery system can be configured to recover only dry material, such as is common on a traditional vacuum cleaner. In another example, the recovery system can be part of a vacuum cleaner that is configured to recover both dry and wet material.

The fluid delivery system 200 can also include an optional heater 230 that can be any suitable heater configured to heat fluids, such as an in-line heater, for example.

The surface cleaning device 202 can also include a control system 232 for operably controlling various components of the surface cleaning device 202, such as the motor/fan assembly 220 and heater 230, for example. The surface cleaning device 202 can further include an actuator 234, such as a button or trigger, which can be selectively actuated to control the delivery of the treating chemistry solution from the storage tank 205 to the dispenser 208 for delivery to the surface 203.

In use, upon actuation of the actuator 234 by a user, the control system 232 can control the flow of liquid from the storage tank 205 through the liquid conduit 210 to the dispenser 208 for dispensing onto the surface 203. In one example, the storage tank 205 or the liquid conduit 210 can be provided with a valve 240 that is operably coupled with the control system 232 for controlling the flow of liquid from the storage tank 205 to the dispenser 208 through the liquid conduit 210 by gravity. Alternatively, or additionally, the surface cleaning device 202 can be provided with a pump (not shown) that is operably coupled with the control system 232 and fluidly coupled with the storage tank 205 to selectively supply liquid from the storage tank 205 to the dispenser 208 through the liquid conduit 210.

The heater 230 can optionally be actuated upon actuation of the actuator 234 or a second, separate actuator (not shown) to heat the treating chemistry solution delivered to the dispenser 208 through the liquid flow circuit 210.

Following the dispensing of the treating chemistry 204 to the surface 203, the treating chemistry 204 can be left on the surface 203 or can be recovered by the recovery system of the surface cleaning device 202 depending on the type of recovery system and the treating chemistry being used. For example, the treating chemistry 204 may be configured to remain on the surface 203 for a predetermined period of time and recovered from the surface while still at least partially in liquid form. This type of treating chemistry would primarily be used with a surface cleaning device 202 in the form of an extraction cleaner or a modified vacuum cleaner having a recovery system configured to recover wet material from the surface 203, which can then be used to recover the dispensed treating chemistry solution from the surface 203 through the nozzle assembly 222. Alternatively, the treating chemistry 204 may be configured to remain on the surface 203 until dry and then any type of recovery system, either a traditional dry recovery system on a vacuum cleaner or wet/dry recovery system of an extraction cleaner can be used to recover the dried treating chemistry 204 from the surface 203 through the nozzle assembly 222. In another example, the treating chemistry 204 may be configured to remain on the surface 203 until dry and either remain with the surface or evaporate.

In addition, while the treating chemistry 204 is illustrated as being dispensed directly to the surface 203 through the liquid flow circuit 206, it is also within the scope of the invention for the treating chemistry 204 to be diluted or mixed with an additional treating chemistry prior to being dispensed onto the surface 203. For example, the liquid flow circuit 206 can be provided with a mixing chamber that is fluidly coupled with the storage tank 205 for receiving the treating chemistry 204 and an additional supply of a treating chemistry stored in a separate tank. Non-limiting examples of an additional supply of a treating chemistry includes a tank holding water or some other solvent for diluting the treating chemistry 204 or another treating chemistry that is different from the treating chemistry 204, such as a fragrance or a treating chemistry that should be stored separately from the treating chemistry 204. The two supplies of treating chemistry can be mixed in the mixing chamber and then supplied to the dispenser 208 through the liquid flow circuit 206 for delivery to the surface 203.

Figure 7:
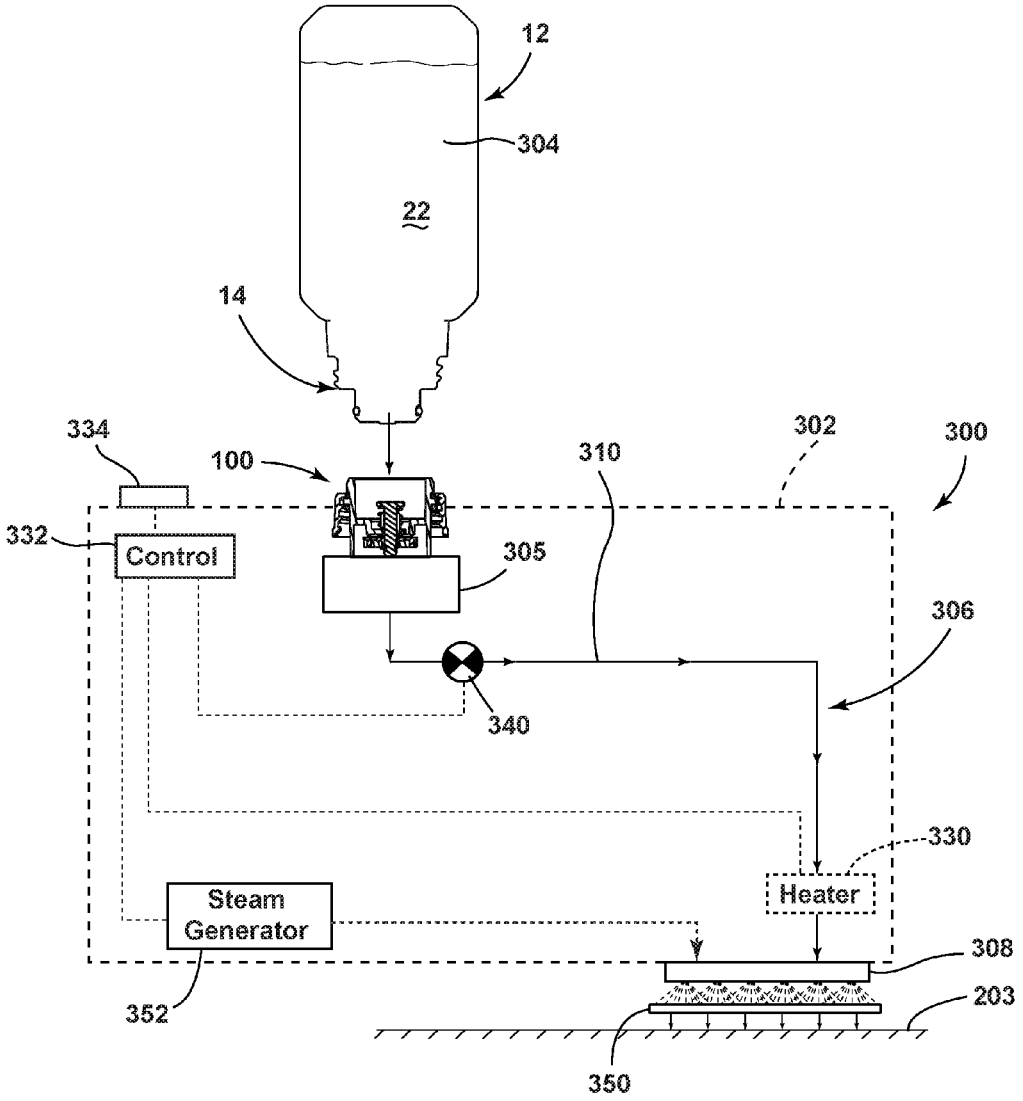
FIG. 7 is a schematic representation of a surface cleaning device having a receiver for use with a container and cap assembly according to an embodiment of the invention.

FIG. 7 illustrates another example of a surface cleaning device 302, which is similar to the surface cleaning device 202 except that the surface cleaning device 302 is configured as a bare floor cleaner, such as a mop or steam mop, for example, and does not include a recovery system. Therefore, parts of the surface cleaning device 302 similar to the surface cleaning device 202 will be labeled with the prefix 300.

The surface cleaning device 302 can include a cleaning head 308 which is configured to dispense a treating chemistry supplied to the cleaning head 308 by the liquid flow circuit 306 to a cleaning pad 350. The cleaning pad 350 can be removably attached to the cleaning head 308 for applying a treating chemistry to the surface 203. The cleaning pad 350 can be moistened with the treating chemistry and then the treating chemistry can be applied to the surface 203 by wiping or scrubbing the moistened cleaning pad 350 over the surface 203.

The fluid delivery system 300 includes a liquid flow circuit 306 that can optionally be provided with a heater 330 to heat the treating chemistry in the liquid flow circuit 306 and/or to generate steam. Alternatively, the surface cleaning device 302 can be provided with a separate steam generator 352 which can provide steam to the cleaning head 308 as an alternative to or in addition to the treating chemistry supplied to the cleaning head 308 by the liquid flow circuit 306.

The delivery of the treating chemistry 304 from the storage tank 305 to the surface 203 by the surface cleaning device 202 is similar to that described above for the surface cleaning device 202 of FIG. 6. Upon actuation of the actuator 334 by a user, the control system 332 can control the flow of liquid from the storage tank 305 through the liquid conduit 310 to the cleaning head 308 for delivery to the cleaning pad 350 for application of the treating chemistry to the surface 203. In one example, the storage tank 305 or the liquid conduit 310 can be provided with a valve 340 that is operably coupled with the control system 332 for controlling the flow of liquid from the storage tank 305 to the cleaning head 308 through the liquid conduit 310 by gravity. Alternatively, or additionally, the surface cleaning device 302 can be provided with a pump (not shown) that is operably coupled with the control system 332 and fluidly coupled with the storage tank 305 to selectively supply liquid from the storage tank 305 to the cleaning head 308 through the liquid conduit 310.

Alternatively, the treating chemistry 304 can be heated by the heater 330 prior to delivery to the cleaning pad 350 to provide a heated treating chemistry solution to the surface 203. In one example, the treating chemistry 304 can be heated by the heater 330 to a high enough temperature to generate steam, such that the treating chemistry 304 is supplied to the cleaning pad 350 as steam.

In the embodiment in which the surface cleaning device 302 includes the steam generator 352, such as when the surface cleaning device 302 is in the form of a steam mop, the steam generator 352 can be actuated upon actuation of the actuator 334 to also supply steam to the cleaning pad 350 when the treating chemistry 304 is supplied to the cleaning pad 350. Alternatively, actuation of the steam generator 352 can be controlled separately from the dispensing of the treating chemistry 304 such that steam can be supplied to the cleaning pad 350 at the same or a different time from the treating chemistry 304.

While the surface cleaning device 302 is disclosed as having a cleaning head 308 which supplies the treating chemistry 304 to a cleaning pad 350, it is also within the scope of the invention for the cleaning head 308 to be configured to dispense the treating chemistry 304 directly the surface 203. For example, when the surface cleaning device 302 is in the form of a steam mop, the cleaning head 308 can be configured to provide steam to the cleaning pad 350 for application to the surface 203 and to provide the treating chemistry 304 directly to the surface 203.

Figure 8:
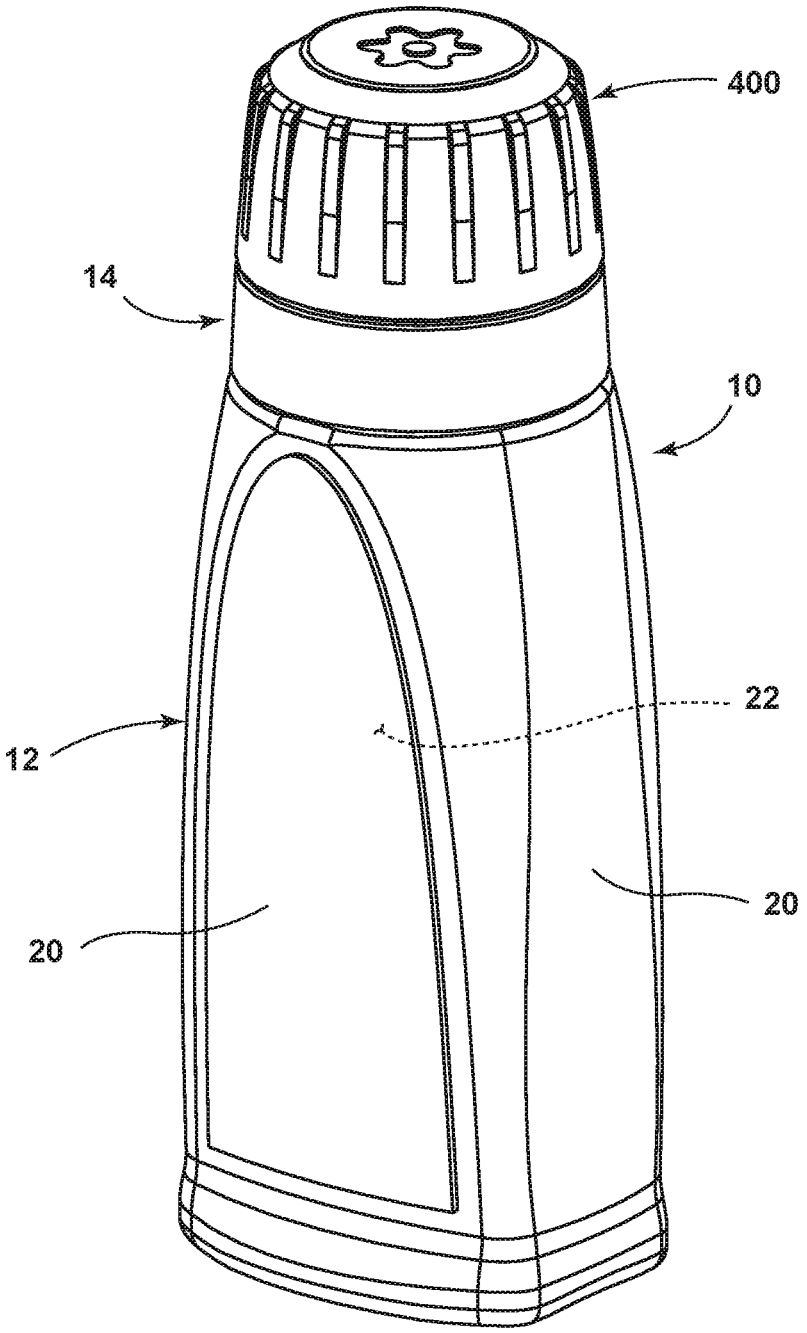
FIG. 8 is a perspective view of a cover for the container and cap assembly according to an embodiment of the invention.
Figure 9:
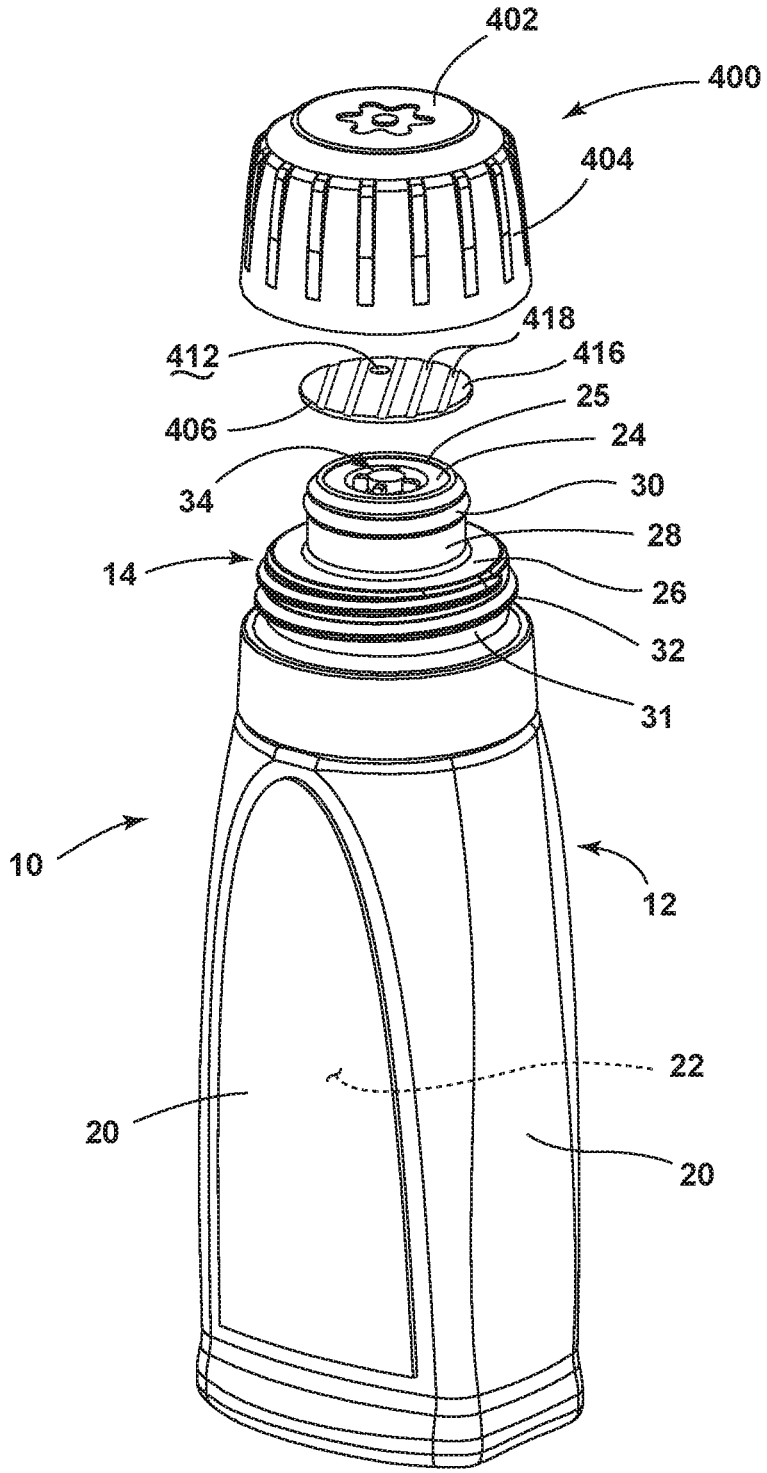
FIG. 9 is a partial exploded view of the cover for the container and cap assembly of FIG. 8 according to an embodiment of the invention.

FIGS. 8 and 9 illustrate a cover 400 for use with the container and cap assembly 10 of FIGS. 1A-B. The cover 400 includes a top wall 402 and a depending sidewall 404. The cover 400 further includes a cover seal 406 having an aperture 412 within which a vapor membrane 414 is positioned (see FIG. 10). An upper face 416 of the cover seal 406 can be provided with a plurality of vent channels 418 to facilitate the flow of gas between the upper face 416 of the cover seal 406 and the cover 400. A series of threads 430 are provided on an inner surface of the cover sidewall 404 for mating with the corresponding threads 32 of the cap 14 (see FIG. 10).

Figure 10:
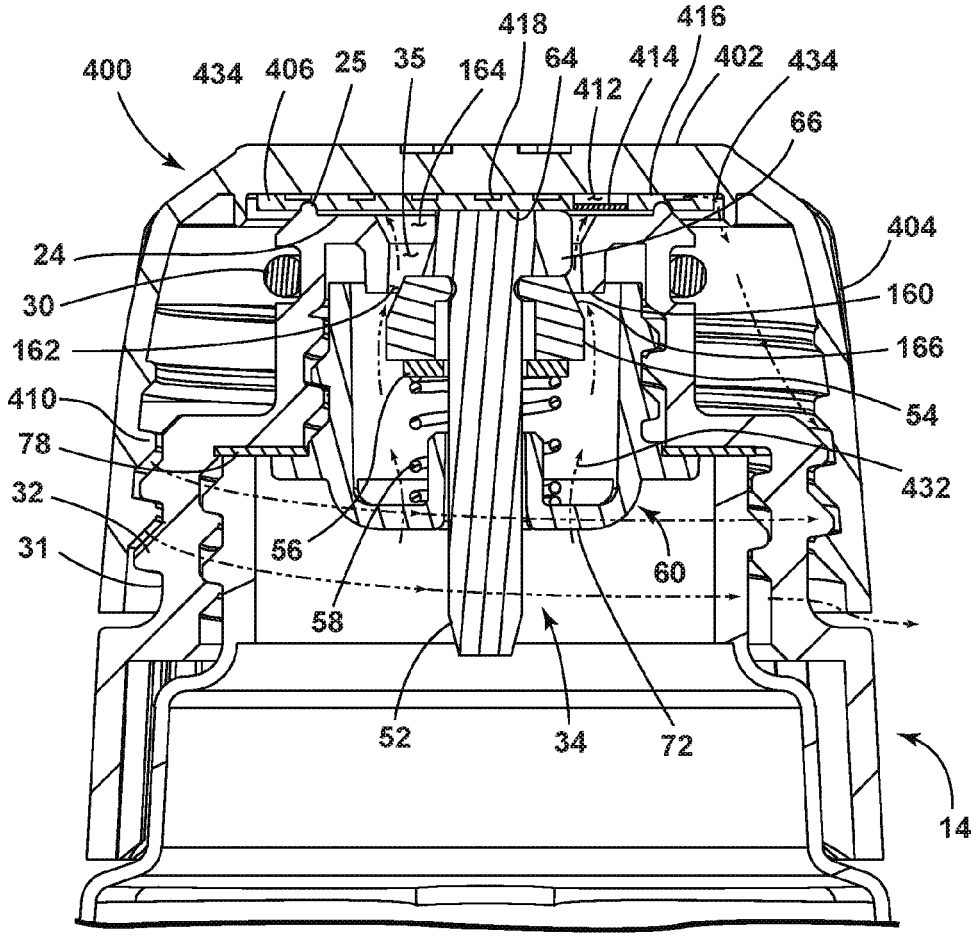
FIG. 10 is a cross-sectional view of the cover and the container and cap assembly of FIG. 8 according to an embodiment of the invention.

Referring now to FIG. 10, the cover seal 406 is provided on an inner surface of the top wall 402 of the cover 400 and is configured to engage the cap plunger 52 when the cover 400 is received on the cap 14 to at least partially open the plunger valve assembly 34 to vent gas from within the container 12. As can best be seen in FIG. 5A, when the plunger valve assembly 34 is in the closed condition, the plunger head 64 extends beyond a plane defined by an upper surface of the circumferential rib 25 on the end face 24 of the cap 14. The cover 400 is configured such that when the cover 400 is threaded onto the cap 14, the cover seal 406 depresses the plunger 52 against the bias of the spring 58 until the plunger head 64 is generally level with the plane defined by the upper surface of the circumferential rib 25.

Depression of the plunger 52 opens the cap plunger valve assembly 34 such that fluid, either liquid or gas, can flow through the cap plunger valve assembly 34. As illustrated by arrows 432, gas within the container 12 can flow through the cap outlet channel 35 and be vented through the vapor membrane 414. The vented gas can travel through the vent channels 418 and exit the cover seal 406 through a gap 434 provided between a perimeter of the cover seal 406 and the cover 400. The gas can then exit the cover 400 through clearance between the cover threads 430 and the cap threads 32.

Typically, the container 12 will only be partially filled with liquid and there will be sufficient head space above the liquid in the container such that liquid is not dispensed through the plunger valve assembly 34 immediately upon opening of the plunger valve assembly 34 by the cover seal 406. However, during transport and storage of the container and cap assembly 10, liquid may be dispensed through the plunger valve assembly 34 when the cover 400 is sealed with the cap 14. The vapor membrane 414 can be selected so as to be gas permeable to allow gas within the container 12 to be vented and liquid impermeable to prevent liquid from being dispensed through the vapor membrane 414. In addition, the cover 400 can be configured to apply enough pressure to the cover seal 406 such that a fluid tight or at least liquid tight seal is formed between the circumferential rib 25 of the cap 14 and the cover seal 406 to minimize leakage of any liquid from the cap 14.

The ability to vent gas from the container and cap assembly 10 during storage can be particularly useful when the contents of the container 12 include a material in which gases can accumulate above the liquid, such as hydrogen peroxide, for example.

To the extent not already described, the different features and structures of the various embodiments may be used in combination with each other as desired. For example, any of the container and cap assemblies 10, receiver 100, fluid delivery systems 200 and 300, surface cleaning devices 202 and 302, and cover 400 may be combined in whole or in part with one another, even if not expressly described. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly disclosed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A system for coupling a container storing a treating chemistry to a surface cleaning device capable of dispensing the treating chemistry to a surface to be cleaned, comprising:

a receiver provided on the surface cleaning device, comprising:

a bottom wall and a receiver sidewall defining a receiver cavity;

a receiver inlet channel through the bottom wall and having an outlet through which fluid can flow into a storage tank of the surface cleaning device; and a receiver plunger valve assembly positioned within the receiver inlet channel to control the flow of fluid through the outlet of the receiver inlet channel, wherein the receiver plunger valve assembly is biased towards a closed condition in which the receiver plunger valve assembly closes the receiver inlet channel; and a cap received on the container to close an open top of the container, comprising:

an end face and a cap sidewall configured to be at least partially received by the receiver cavity;

a cap outlet channel through the end face; and a cap plunger valve assembly positioned within the cap outlet channel to control the dispensing of fluid from the container through the cap outlet channel, wherein the cap plunger valve assembly is biased towards a closed condition in which the cap plunger valve assembly closes the cap outlet channel;

wherein the cap plunger valve assembly comprises a cap plunger, a valve seal carried on the cap plunger, and a biasing element, wherein the biasing element biases the cap plunger and valve seal toward the closed condition; and wherein the cap is configured to be coupled with the receiver, and wherein the receiver plunger valve assembly and the cap plunger valve assembly are configured to engage with each other and move to an open condition upon coupling of the cap with the receiver to permit fluid to flow through the cap and the receiver.

2. The system of claim 1, wherein the receiver plunger valve assembly is configured to at least partially open prior to the cap plunger valve assembly upon inserting the cap into the receiver cavity and wherein the cap plunger valve assembly is configured to close prior to the receiver plunger valve assembly upon removing the cap from the receiver cavity.

3. The system of claim 1, wherein:

the receiver plunger valve assembly comprises a receiver plunger and a receiver spring which biases the receiver plunger toward the closed condition;

the biasing element comprises a cap spring; and the spring constant of the cap spring is greater than the spring constant of the receiver spring, such that upon engagement of the cap plunger and the receiver plunger, the receiver plunger valve assembly is opened prior to the cap plunger valve assembly.

4. The system of claim 3, wherein the receiver further comprises a collar on the bottom wall which retains the receiver plunger relative to the receiver inlet channel, wherein the receiver plunger is configured to engage the collar in a fully depressed position of the receiver plunger valve assembly.

5. The system of claim 1, wherein the receiver plunger valve assembly comprises a receiver plunger, a receiver valve seal carried on the receiver plunger, and a receiver biasing element, wherein the receiver biasing element biases the receiver plunger and the receiver valve seal toward the closed condition such that the receiver valve seal seals against a sealing surface of the receiver.

6. The system of claim 5, wherein the receiver plunger comprises a stem and a plunger head, wherein the circumference of the plunger head comprises a wavy profile to facilitate the flow of fluid around the plunger head and into the receiver inlet channel.

7. The system of claim 5, wherein the receiver plunger valve assembly further comprises a retaining element retaining the receiver plunger relative to the receiver inlet channel, wherein the retaining element includes a collar supporting the receiver plunger relative to the receiver inlet channel and supported within the receiver inlet channel by a plurality of arms.

8. The system of claim 1, wherein the cap plunger comprises a stem and a plunger head, wherein the valve seal is provided on the stem, adjacent the plunger head.

9. The system of claim 1, wherein the cap plunger valve assembly further comprises a retaining element retaining the cap plunger and valve seal relative to the cap.

10. The system of claim 9, wherein the retaining element comprises a webbing that includes a first aperture for receiving the cap plunger and a plurality of second apertures which define channels through which fluid can flow through the retaining element.

11. The system of claim 1, wherein the cap further comprises a rim on the end face defining an inlet to the cap outlet channel, wherein the biasing element biases the valve seal toward the rim to seal the inlet to the cap outlet channel.

12. The system of claim 11, wherein the valve seal comprises an angled sealing face which seats within the rim to form a fluid tight seal between the valve seal and the rim when the cap plunger valve assembly is in the closed condition.

13. The system of claim 1, wherein the cap further comprises stop wall spaced from the end face, wherein the cap sidewall extends between the end face and the stop wall, and wherein the stop wall engages an upper end of the receiver when the cap is coupled with the receiver.

14. The system of claim 13, wherein a first distance is defined between a head of the receiver plunger valve assembly and the upper end of the receiver and a second distance is defined between the a head of the cap plunger valve assembly and the stop wall, wherein the first distance is less than the second distance such that the head of the cap plunger valve assembly engages the head of the receiver plunger valve assembly prior to the stop wall engaging the upper end of the receiver.

15. The system of claim 14, wherein the cap further comprises a cap seal on an exterior of the cap sidewall, wherein the cap seal engages the receiver sidewall to form a seal between the cap and the receiver when the cap is coupled with the receiver.

16. The system of claim 1, wherein the receiver and cap are made from at least one of polypropylene, polyphenylene-polystyrene blends, ethylene propylene diene monomer (EPDM), or stainless steel.

17. The system of claim 1, and further comprising a cover removably received on the cap and a cover seal between the cover and the cap, wherein the cover seal comprises an aperture and engages the cap plunger valve assembly to at least partially open the cap plunger valve assembly to vent gas from within the container through the aperture.

18. The system of claim 17, wherein a vapor membrane is positioned within the aperture of the cover seal.

19. The system of claim 18, wherein the cover seal is provided on an inner surface of the cover and an upper face of the cover seal comprises a plurality of vent channels to facilitate the flow of a gas between the upper face of the cover seal and the cover.

* * * * *